US005478216A

United States Patent [19]

Neward

[11] Patent Number: 5,478,216

[45] Date of Patent: Dec. 26, 1995

[54] VACUUM LIMITER FOR PUMP

[76] Inventor: Theodore C. Neward, P.O. Box 725, Cucamonga, Calif. 91730

[21] Appl. No.: 118,132

[22] Filed: Sep. 8, 1993

[51] Int. Cl.[6] ..... F04B 41/00

[52] U.S. Cl. ..... 417/440; 417/441; 417/53; 137/114; 137/907

[58] Field of Search ..... 417/440, 441, 417/53; 137/114, 512.3, 526, 907

[56] References Cited

U.S. PATENT DOCUMENTS

| | | | |
|---|---|---|---|
| 3,612,722 | 10/1971 | Neward | 417/63 |
| 4,775,302 | 10/1988 | Neward | 417/440 |
| 4,806,084 | 2/1989 | Neward | 417/440 |
| 4,954,054 | 9/1990 | Neward | 417/440 |
| 4,979,883 | 12/1990 | Neward | 417/440 |
| 4,979,883 | 12/1990 | Neward | 417/441 |
| 5,112,203 | 5/1992 | Neward | 417/440 |
| 5,277,557 | 1/1994 | Cooper | 417/440 |

*Primary Examiner*—Richard A. Bertsch
*Assistant Examiner*—William Wicker
*Attorney, Agent, or Firm*—Lyon & Lyon

[57] ABSTRACT

A hand-held vacuum pump with an attached vacuum limiter valve is disclosed. The pump includes a cylinder coupled with a handle, a piston in the cylinder coupled with another handle, along with a suitable valving assembly for allowing a vacuum to be drawn at an inlet of the pump. More particularly, there is also disclosed a vacuum limiter which can be attached to or form an integral part of the pump. The vacuum limiter includes a valve which is attached to the cylinder outlet port and which is adjustable for allowing the limit vacuum to be set.

11 Claims, 2 Drawing Sheets

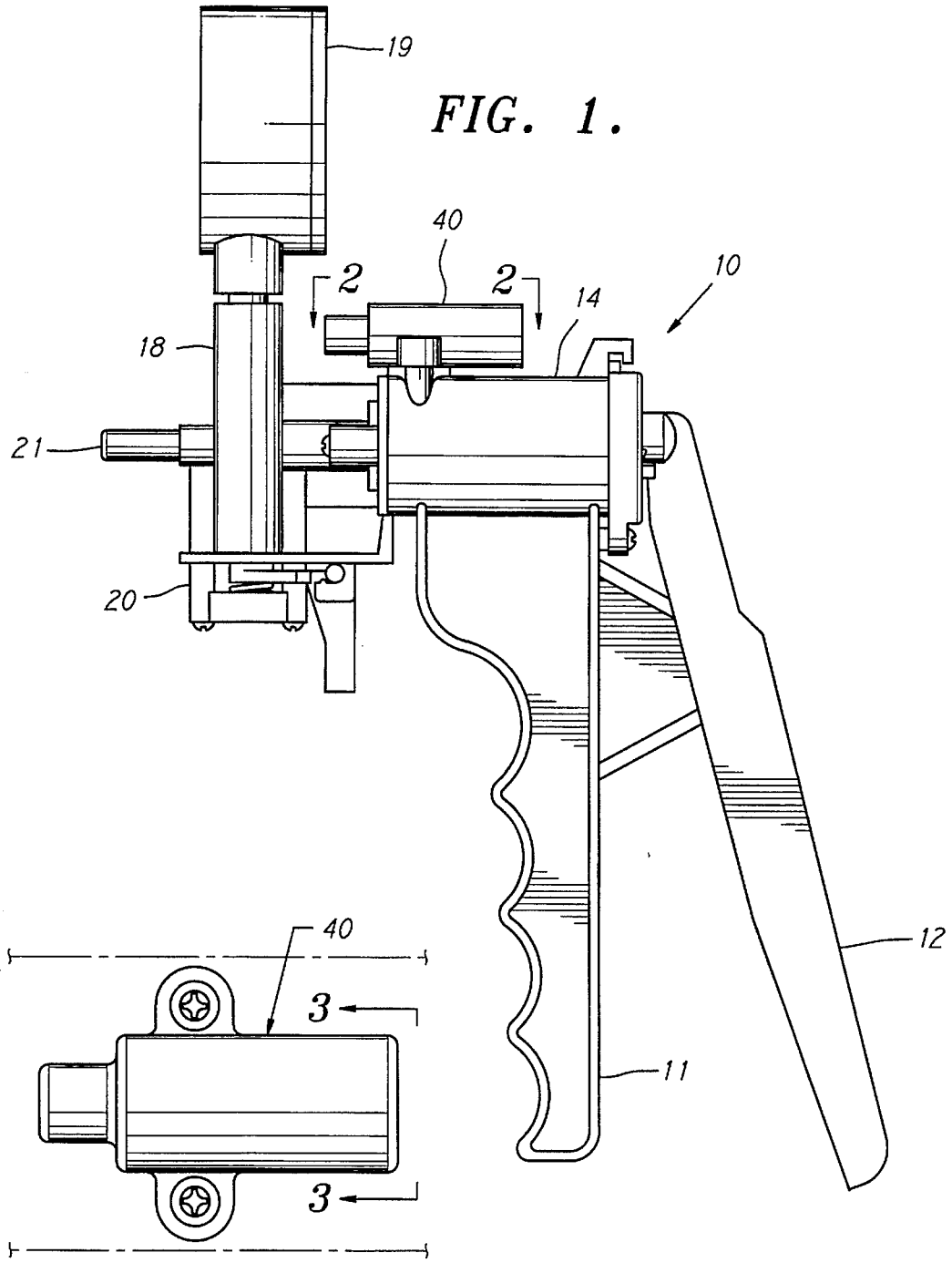
FIG. 1.
FIG. 2.
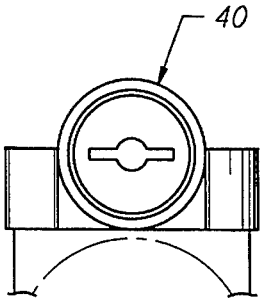
FIG. 3.

VACUUM LIMITER FOR PUMP

FIELD OF INVENTION

This application relates to the field of hand-held vacuum and pressure pumps, particularly of the type disclosed in U.S. Pat. Nos. 3,612,722, 4,775,302, 4,806,084, 4,954,054, and 5,112,203 by the present inventor, the disclosures of which are incorporated by reference.

BACKGROUND

Hand-held vacuum and pressure pumps are generally useful whenever vacuum or pressure is desired. Vacuum or pressure can be created, for example, by compressing (i.e. squeezing) and releasing a handle of such a vacuum or pressure pump. Generally, such squeezing and releasing causes a piston to move in a cylinder of the pump thereby creating vacuum or pressure. Many types of vacuum pumps have been devised, but they often suffer from such drawbacks as complexity, expense, excessive bulk, inability to pull a suitable vacuum, and the like. The vacuum pump of the referenced patents has significantly solved the need for a vacuum pump which is simple, inexpensive, lightweight, compact, and portable, and one which can pull a useful vacuum.

Such hand-held vacuum and pressure pumps are especially useful for various tasks such as aiding in performing vacuum extractions during childbirth, and are useful in various industries, such as the automotive industry, for liquid sampling and vacuum system testing and repair. Vacuum pumps manufactured according to the aforesaid patents have the ability to pull a vacuum of, for example, twenty-eight inches of mercury.

In some applications, it is desirable to pull a preset or controlled vacuum, and one which is repeatable. Inasmuch as the hand-held vacuum pump is manually operated by hand and because the pump can quickly pull a relatively high vacuum, it is difficult to manually pull a given level of vacuum. One way to accomplish this is disclosed in U.S. Pat. No. 4,979,883. That patent discloses a vacuum limiter that uses two distinct valves, one to meter the vacuum pressure, and the second to hold the vacuum. Both of these valves are located on the source side of the vacuum pump, so the valves have to maintain the difference in pressure between the vacuum and the vacuum cylinder. This leads to problems with drawing an accurate vacuum and holding it.

SUMMARY OF THE INVENTION

The present invention provides an improvement on the aforesaid vacuum pumps by enabling a preset vacuum to be obtained in a simple manner, and lends the pump to a wider range of potential uses. Additionally, the present vacuum limiter improves on previous vacuum limiters by enhancing the accuracy of the preset settings and serving to hold the vacuum better. The preferred embodiment of the current invention combines a metering check valve to limit the vacuum, and an exhaust valve, both of which are connected to the outlet port of the pump's cylinder. Experimentation has shown that this configuration enhances the accuracy of the vacuum limiter. Furthermore, because the present invention utilizes only one valve to limit the vacuum, the cost and complexity of manufacturing are both reduced.

Accordingly, it is an object of the present invention to provide an improved hand-held vacuum pump.

Another object of this invention is to provide an improved vacuum limiter for a hand-held vacuum pump.

Another object of this invention is to provide a vacuum limiter which can be used for retrofitting or attachment to a hand-held vacuum pump.

BRIEF DESCRIPTION OF THE DRAWINGS

These and other objects of the present invention will become better understood through a consideration of the following description taken in conjunction with the drawings in which:

FIG. 1 is a side view showing a hand-held vacuum pump of the type shown and disclosed in the referenced patents, including an attached vacuum limiter according to the present invention;

FIG. 2 is a top view of the vacuum limiter, taken along a line 2—2 in FIG. 1;

FIG. 3 is a rear view of the vacuum limiter, taken along a line 3—3 in FIG. 2;

DETAILED DESCRIPTION

Figure 4:
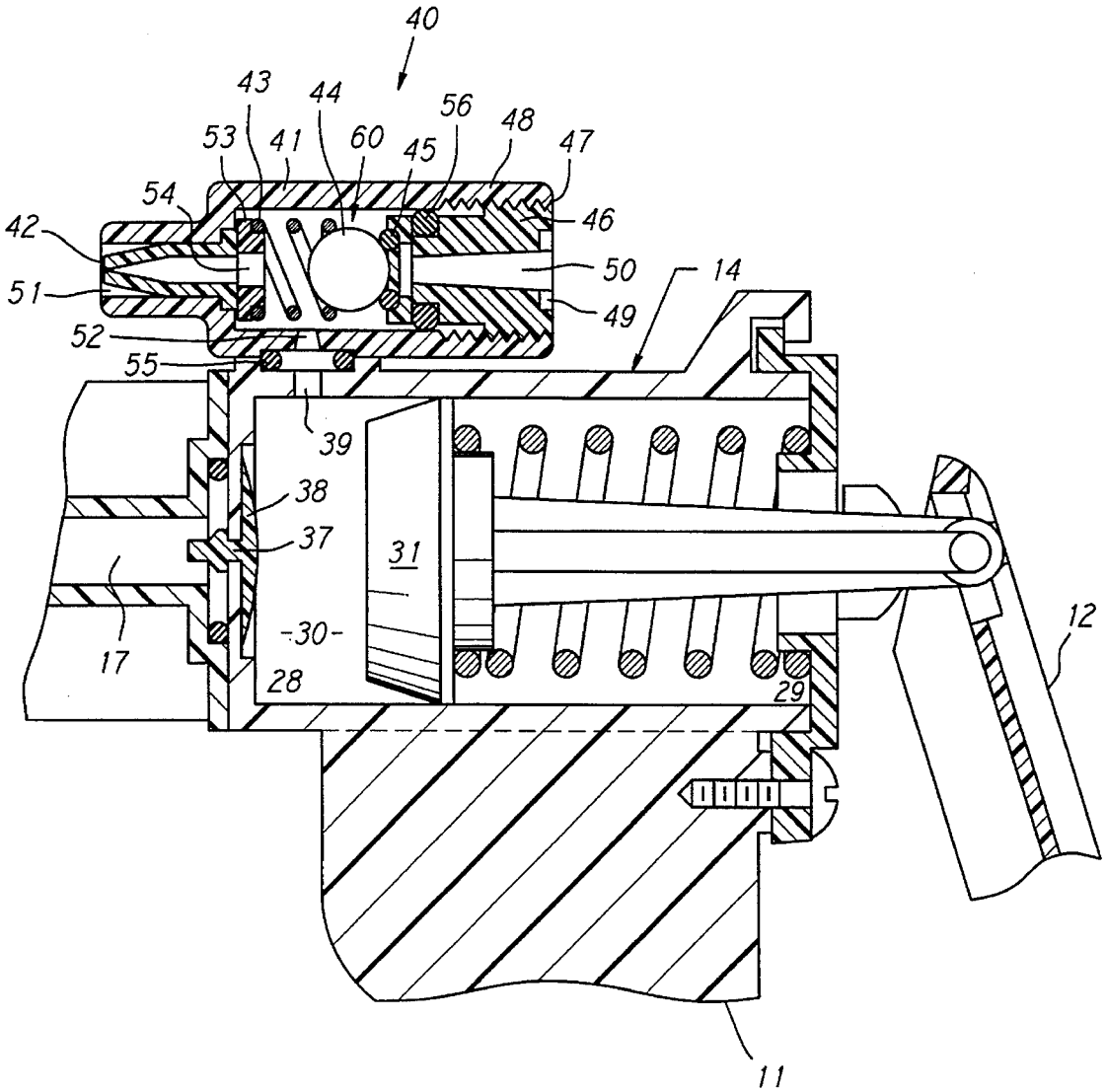
FIG. 4 is a detailed cross-sectional view of the vacuum pump cylinder and the vacuum limiter.

Turning now to the drawings, FIG. 1 depicts a hand-held vacuum pump 10 of the type disclosed in the referenced patents. As more fully described in U.S. Pat. No. 4,806,084 and the other referenced patents, the pump 10 comprises fixed and movable handles 11, 12 which can be squeezed together to operate a piston 31 within a sealed cylinder 14. This motion of the piston causes air to be drawn from an inlet channel 17 into a chamber 30 inside the cylinder 14.

A vacuum limiter 40 shown in FIGS. 1–4 includes a ball check valve 60 and a duckbill valve 42. The ball check valve 60 is adjustable and operates to limit the amount of vacuum pressure that the pump 10 can pull. The duckbill valve 42 operates to exhaust the air out of the pump when the piston moves toward an inlet port 37.

FIG. 1 shows a manifold 18 attached to the vacuum pump 10, which can be used to attach different components. The components shown in FIG. 1 are a pressure gauge 19 and a vacuum release 20. A source port 21 is shown at the left side of the manifold. This port 21 can be attached to the apparatus for which a vacuum is desired.

The basic parts of the vacuum pump 10 operate similarly to the pump disclosed in U.S. Pat. No. 4,806,084. As will be apparent to those skilled in the art, squeezing the fixed and movable handles 11 & 12 together causes the piston 31 to be reciprocated back and forth in the cylinder 14 under spring tension as more fully described in U.S. Pat. No. 4,806,084. This causes a vacuum to be drawn at the inlet port 37.

The vacuum is drawn in the following manner. When the piston 31 is withdrawn from an inlet end 28 to an outer end 29 of the cylinder (FIG. 4 shows the piston near the inlet end 28), the air pressure in the chamber 30 decreases, thus causing a pressure differential between the air in the inlet channel 17 and the chamber 30. An umbrella valve 38 operates to allow air to flow from the inlet channel 17 to the chamber 30, but not in the opposite direction, as is well known in the art. As air flows from the inlet channel 17, a vacuum is created at the inlet channel 17 and any device (eg. a container) thereto because the pressure is lower than in the atmosphere.

The vacuum limiter 40 operates by restricting the vacuum that can be drawn in the cylinder chamber 30 to a preset or adjustable level. By restricting the vacuum allowed in the cylinder chamber 30, the pressure differential between the chamber 30 and the inlet channel 17 is reduced, so that the resultant vacuum is restricted.

The vacuum limiter 40 of the present invention is attached directly to the cylinder 14 with an open channel between the two. The open channel comprises an outlet port 39 opening in the cylinder 14 and a vacuum limiter port 52 opening in the wall of a housing 41 of the vacuum limiter 40. This channel is sealed using an o-ring 55 to prevent air leaks. The preferred embodiment of the vacuum limiter uses a ball check valve 60, as shown in FIG. 4. The ball check valve 60 generally includes a spring 43, a steel ball 44 and an o-ring 45, and operates in the following manner. The spring 43 holds the steel ball 44 in place against the o-ring 45, thus biasing the valve 60 to a closed position. The preferred embodiment shows a plug channel 50 through which the atmosphere contacts the steel ball 44. The contact between the steel ball 44 and the o-ring 45 provides a seal so that no air can enter the vacuum limiter when the pressure is approximately the same in the atmosphere and inside the vacuum limiter (note that the pressure inside the vacuum limiter 40 is equal to the pressure inside the chamber 30 because there is an unobstructed channel between the two 39 & 52). Therefore, when the piston 31 is withdrawn and the pressure inside the chamber 30 and vacuum limiter 40 is reduced, the pressure on the steel ball 44 is less on the inside of the vacuum limiter than on the area of the steel ball 44 exposed to the atmosphere. Because of this pressure differential, the spring 43 is compressed and the steel ball 44 is withdrawn from the o-ring 45, allowing air to enter the vacuum limiter 40 and the chamber 30. This limits the amount of a vacuum that the pump can pull.

The ball check valve 60 can be preset or adjustable. A preset version (not shown) will allow a set pressure to be drawn, the actual amount of which will depend on the physical characteristics of the spring 43, the steel ball 44, and the size of the plug channel 50.

A preferred adjustable valve 60 is shown in FIG. 4. The spring 43 is attached at one end to a coupler 53 that mounts directly over the duckbill valve 42. The other end is frictionally held in place by the steel ball 44, which contacts an adjustable plug 46 via an o-ring 45. The adjustable plug 46 has a plug channel 50 to allow air to contact the steel ball 44. The adjustable plug 46 has external threads 47 mating with internal threads 48 of the housing 41, and has a suitable slot 49 for allowing adjustment by a coin or screwdriver (also see FIG. 3). The slot 49 allows the plug 46 to be screwed in or out (to the left or right as seen in FIG. 4) so as to adjust the force applied to the spring 43 via the steel ball 44, and thus adjust the maximum level of vacuum that can be drawn through the limiter. An o-ring 56 provides a seal so that no air can escape between the plug 46 and the housing 41.

In the preferred embodiment, the duckbill valve 42 is also housed in the vacuum limiter 40 assembly. It is not functionally necessary that the duckbill 42 be located here, but it is done in the preferred embodiment for simplicity and to reduce the number of parts. The duckbill valve 42 is used as an exhaust valve. When the piston 31 is moved to,the inlet end 28 of the chamber 30, the pressure inside the chamber increases because the volume decreases. The pressure differential causes the duckbill valve 42 to open to expel the excess air through a duckbill valve channel 51 in the housing 41, thereby equalizing the pressure inside and outside. Note that the coupler 53 has a channel 54 to allow air to pass to the duckbill valve 42. The ball check valve 60 and the umbrella valve 38 only allow air flow in one direction (into the vacuum limiter/chamber), so they are not involved in exhaust.

While embodiments of the present invention have been shown and described, various modifications may be made without departing from the scope of the present invention, and all such modifications and equivalents are intended to be covered.

I claim:

1. A hand-held vacuum pump, comprising a cylinder for isolating a volume from the atmosphere and having an inlet and an outlet port, biased piston means for drawing a vacuum through the inlet port of the cylinder and including a piston which can be moved in the cylinder, handle means coupled with the cylinder and the piston means, and a vacuum limiter connected to and in communication with the outlet port for controlling a maximum vacuum to be drawn by the pump, said vacuum limiter including a metering check valve which is adjustable to set the maximum vacuum level.

2. A pump as in claim 1 wherein said metering check valve is a ball check valve which comprises a ball that interfaces with an o-ring so as to allow air to enter said vacuum limiter only at pressure differentials over a specified threshold, and a spring to bias the ball check valve to a closed position when the pressure differential is below a specified threshold.

3. A pump as in claim 1 wherein said metering check valve is adjustable by using a coin or screwdriver to adjust the tension of a spring in the vacuum limiter.

4. A pump as in claim 1 wherein said vacuum limiter comprises said metering check valve and an exhaust valve, wherein both of the valves are contained in a unitary structure and use the same outlet port from said cylinder.

5. A hand-held vacuum pump, comprising a cylinder for isolating a volume from the atmosphere and having an inlet and an outlet port, biased piston means for drawing a vacuum through the inlet port of the cylinder and including a piston which can be moved in the cylinder, handle means coupled with the cylinder and the piston means, and a vacuum limiter contained in a unitary structure that comprises both a ball check valve and an exhaust valve, where both valves are connected to and in communication with the outlet port from said cylinder, said ball check valve being adjustable to set a maximum vacuum level, said ball check valve comprising a ball that interfaces with an o-ring so as to allow air to enter said vacuum limiter only at pressure differentials over a specified threshold, and a spring to bias the ball check valve to a closed position when the pressure differential is below a specified threshold, and wherein said ball check valve is adjustable to adjust the spring in the vacuum limiter.

6. A hand-held vacuum pump, comprising a cylinder for isolating a volume from the atmosphere and having an inlet and an outlet port, biased piston means for drawing a vacuum through the inlet port of the cylinder and including a piston which can be moved in the cylinder, handle means coupled with the cylinder and the piston means, and a vacuum limiter connected to and in communication with the outlet port for controlling the maximum vacuum to be drawn by the pump, said vacuum limiter including a metering check valve which is adjustable to set maximum vacuum level, where said metering check valve comprises a spring biased plunger and an adjustable plug so as to allow air to enter said vacuum limiter only at pressure differentials over a specified threshold.

7. A hand-held vacuum pump, comprising a cylinder for isolating a volume from the atmosphere and having an inlet and an outlet port, biased piston means for drawing a vacuum through the inlet port of the cylinder and including a piston which can be moved in the cylinder, handle means coupled with the cylinder and the piston means, and a vacuum limiter including a metering check valve and connected to and in communication with the outlet port for controlling a maximum vacuum level to be drawn by the pump.

8. The hand-held vacuum pump of claim 7 wherein said outlet port defines an open channel for allowing fluid communication between said vacuum limiter and said cylinder.

9. The hand-held vacuum pump of claim 7 wherein said metering check valve is a ball check valve which comprises a ball that interfaces with an o-ring so as to allow air to enter said vacuum limiter only at pressure differentials over a specified threshold, and a spring to bias the ball check valve to a closed position when the pressure differential is below a specified threshold.

10. The hand-held vacuum pump of claim 7 wherein said vacuum limiter comprises said metering check valve and an exhaust valve, wherein both of the valves are contained in a unitary structure and are in communication with said outlet port from said cylinder.

11. A method of drawing a vacuum using a hand-held vacuum pump which comprises:

moving a biased piston within a cylinder using handle means connected to said piston and said cylinder, to draw a volume of air into said cylinder through an inlet port in said cylinder; and opening a metering check valve to draw air into said cylinder when the air in said cylinder reaches a maximum vacuum level, said metering check valve being connected to and in communication with an outlet port of the cylinder.

* * * * *